US009332850B2

(12) United States Patent
Krishtul

(10) Patent No.: US 9,332,850 B2
(45) Date of Patent: May 10, 2016

(54) REVERSIBLE ORTHOPEDIC SEAT CUSHION

(71) Applicant: Max Krishtul, Brooklyn, NY (US)

(72) Inventor: Max Krishtul, Brooklyn, NY (US)

( * ) Notice: Subject to any disclaimer, the term of this patent is extended or adjusted under 35 U.S.C. 154(b) by 0 days.

(21) Appl. No.: 14/074,633

(22) Filed: Nov. 7, 2013

(65) Prior Publication Data

US 2015/0108802 A1 Apr. 23, 2015

Related U.S. Application Data

(63) Continuation-in-part of application No. 29/470,326, filed on Oct. 18, 2013, now Pat. No. Des. 722,449.

(51) Int. Cl.
*A47C 7/02* (2006.01)
*A47C 7/18* (2006.01)

(52) U.S. Cl.
CPC ..... *A47C 7/022* (2013.01); *A47C 7/021* (2013.01); *Y10T 29/481* (2015.01)

(58) Field of Classification Search
CPC ..... A47G 9/10; A47G 2009/1018; A47G 9/0253; A47C 7/022; A47C 7/021; A47C 7/02; A61G 5/1043; A61G 2005/1045
USPC ..... 5/653, 652, 655.9, 953, 636, 490; 297/452.26, 452.23, 452.21, 452.48; D6/601
See application file for complete search history.

(56) References Cited

U.S. PATENT DOCUMENTS 3,503,649 A * 3/1970 Johnson ..... 297/452.26
D238,235 S * 12/1975 Elgebrandt ..... D6/596
4,132,228 A 1/1979 Green
4,164,798 A 8/1979 Weber
4,643,481 A 2/1987 Saloff et al.
4,709,431 A * 12/1987 Shaktman ..... 5/653
4,718,727 A 1/1988 Sheppard
4,989,284 A 2/1991 Gamm
5,018,790 A 5/1991 Jay
5,033,133 A * 7/1991 Nissen ..... 5/653
D318,923 S * 8/1991 Marsh ..... D24/183
D327,389 S * 6/1992 Flores et al. ..... D6/601
5,144,705 A 9/1992 Rogers
5,402,545 A 4/1995 Jolley (Continued)

FOREIGN PATENT DOCUMENTS

FR 1271660 A 9/1961
TW 2004332286 A 9/2014

OTHER PUBLICATIONS https://web.archive.org/web/20130502051749/http://www.rehabmart.com/product/jay-j2-plus-cushions-25901.html, Internet Archive, Jay J2 Plus Cushions, catalog, May 2, 2013, 2 pages, Elberton, GA, USA.

(Continued)

*Primary Examiner* — Robert G Santos
(74) *Attorney, Agent, or Firm* — IDP Patent Services; Olav M. Underdal

(57) ABSTRACT

A reversible orthopedic seat cushion can include a right leg support channel, a left leg support channel, a rear cutout, and a front contoured protuberance, which can allow a person sitting in the cushion to experience reduced pressure on the persons coccyx, while having support and guidance to the position of the legs. The seat cushion can also be used in a reversed position. The features of the cushion may promote a healthy sitting posture, and proper spine alignment, and may reduce or prevent back pain. Also disclosed is a method for configuring a support contour of a cushion.

19 Claims, 5 Drawing Sheets

(56) References Cited

U.S. PATENT DOCUMENTS

| | | | | | |
|---|---|---|---|---|---|
| 5,522,106 | A * | 6/1996 | Harrison et al. | 5/653 | |
| D386,036 | S * | 11/1997 | Laidlaw | D6/601 | |
| 5,702,153 | A | 12/1997 | Pliska | | |
| D396,981 | S * | 8/1998 | Laidlaw | D6/601 | |
| D399,694 | S * | 10/1998 | Laidlaw | D6/601 | |
| 5,845,352 | A | 12/1998 | Matsler et al. | | |
| 6,142,573 | A * | 11/2000 | Harding et al. | 297/452.25 | |
| 6,202,234 | B1 * | 3/2001 | Henderson | 5/653 | |
| 6,241,320 | B1 * | 6/2001 | Chew et al. | 297/452.26 | |
| 6,611,980 | B2 | 9/2003 | Wempe | | |
| 6,929,325 | B1 | 8/2005 | Goelo | | |
| 6,990,744 | B2 * | 1/2006 | Bieganek et al. | 33/515 | |
| 7,140,057 | B2 * | 11/2006 | Hetzel et al. | 5/653 | |
| 7,216,388 | B2 * | 5/2007 | Bieganek et al. | 5/653 | |
| 7,220,376 | B2 * | 5/2007 | Hetzel et al. | 264/125 | |
| 7,225,486 | B2 | 6/2007 | Jackson | | |
| 7,344,196 | B2 | 3/2008 | Rodriquez et al. | | |
| 7,373,678 | B2 * | 5/2008 | Hetzel et al. | 5/653 | |
| 7,395,566 | B2 * | 7/2008 | Hetzel et al. | 5/653 | |
| 7,614,704 | B2 * | 11/2009 | Whelan | A47C 7/021 297/452.25 | |
| 7,891,033 | B2 * | 2/2011 | Loewenthal et al. | 5/653 | |
| D642,846 | S | 8/2011 | Parish | | |
| D722,449 | S * | 2/2015 | Krishtul | D6/601 | |
| 9,021,637 | B1 * | 5/2015 | Whelan | A61G 5/1043 297/452.25 | |
| 2005/0022305 | A1 * | 2/2005 | Bieganek et al. | 5/630 | |
| 2005/0022306 | A1 * | 2/2005 | Hetzel et al. | 5/654 | |
| 2005/0022406 | A1 * | 2/2005 | Bieganek et al. | 33/512 | |
| 2005/0025953 | A1 * | 2/2005 | Hetzel et al. | 428/304.4 | |
| 2005/0235423 | A1 * | 10/2005 | Hetzel et al. | 5/653 | |
| 2007/0028385 | A1 * | 2/2007 | Hetzel et al. | 5/653 | |
| 2008/0079306 | A1 * | 4/2008 | Whelan | A47C 7/021 297/452.41 | |
| 2009/0222992 | A1 * | 9/2009 | Loewenthal et al. | 5/653 | |
| 2013/0060282 | A1 | 3/2013 | Pham | | |
| 2013/0113264 | A1 * | 5/2013 | Pham | A47C 7/022 297/452.21 | |
| 2013/0198961 | A1 | 8/2013 | Davis et al. | | |
| 2015/0108802 | A1 * | 4/2015 | Krishtul | A47C 7/022 297/283.1 | |
| 2015/0164727 | A1 * | 6/2015 | Lopez | A47G 9/10 5/653 | |
| 2015/0313365 | A1 * | 11/2015 | Thomas | A47C 1/16 5/653 | |

OTHER PUBLICATIONS

Contour Living, Freedom Seat, website, Jan. 16, 2010, 2 pages, https://web.archive.org/web/20100116164451/http://contourliving.com/.

J-LIKE120728, Source: USPO ReExamination Request for D722449, Purchasing Contract, Jul. 16, 2012, 4 pages.

Amazon, Deluxe Comfort Bottom Reformulator Cushion, Amazon website, retrieved Jan. 4, 2016, 7 pages, http://www.amazon.com/Deluxe-Comfort-Bottom-Reformulator-Cushion/dp/B003NUCC3W/ref=cm_, Source, Re-Examination Request D722449.

Deluxe Comfort, Bottom Reformulator Cushion, Catalogue, Internet Web Archives May 11, 2010, 3 pages, https://web.archive.org/web/20100511065736/http://www.deluxecomort.com/bottom-reformulator-cushion.

* cited by examiner

Reversible Orthopedic Seat Cushion

REVERSIBLE ORTHOPEDIC SEAT CUSHION

CROSS-REFERENCE TO RELATED APPLICATIONS

This application is a continuation-in-part of U.S. Design application Ser. No. 29/470,326, filed Oct. 18, 2013.

FIELD OF THE INVENTION

The present invention relates generally to the field of seat cushions, and more specifically to seat cushions that have orthopedic contours, and are adapted to reduce pressure on the coccyx.

BACKGROUND OF THE INVENTION

A seat cushion aims to provide a comfortable seating experience. Seat cushions can either be designed for permanent position in a chair or be designed for portable use in different seating situation, such as for example in different chairs, cars seats, and wheelchairs.

Contoured cushions are well known, and there are several well-known variants of cushions designed for reducing pressure on the coccyx. However existing cushion design generally do not provide adequate support for the legs, and when designed with features to reduce pressure on the coccyx they almost always include a significant slant, which while promoting reducing pressure in the rear part of the cushion, also can result in a more unstable seating position.

Generally, these past cushion designs may achieve a goal of reducing pressure on the coccyx, but due to their inadequate support and unstable seating position, may not promote or ensure an overall healthy seating posture and proper spine alignment.

As such, considering the foregoing, it may be appreciated that there continues to be a need for novel and improved devices and methods for countered cushions designed for reducing pressure on the coccyx.

SUMMARY OF THE INVENTION

The foregoing needs are met, to a great extent, by the present invention, wherein in aspects of this invention, enhancements are provided to the existing model of seat cushions.

In an aspect, a reversible orthopedic seat cushion can include a right leg support channel, and a left leg support channel, where both leg support channel run parallel to the sides, substantially in the middle between the sides and the centerline of the cushion. The leg support channels serve to support, guide, and position the legs of a person seated in the cushion.

In a related aspect, the reversible orthopedic seat cushion can further include a rear-cutout, which serves to reduce any pressure on the coccyx of a person seated in the cushion.

In a related aspect, the reversible orthopedic seat cushion can further include a front concave contoured protuberance, which allows the seat cushion to be used in a reversed position, which can provide a different type of support for a person sitting with the seat cushion in the reversed position.

In related aspects, the leg support channels can have various degrees of negative or positive slant, or a slant of substantially zero.

In a related aspect, the reversible orthopedic seat cushion can be manufactured with an inner core of high-resilience upholstery foam.

In a related aspect, the reversible orthopedic seat cushion can further include a cushion cover.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
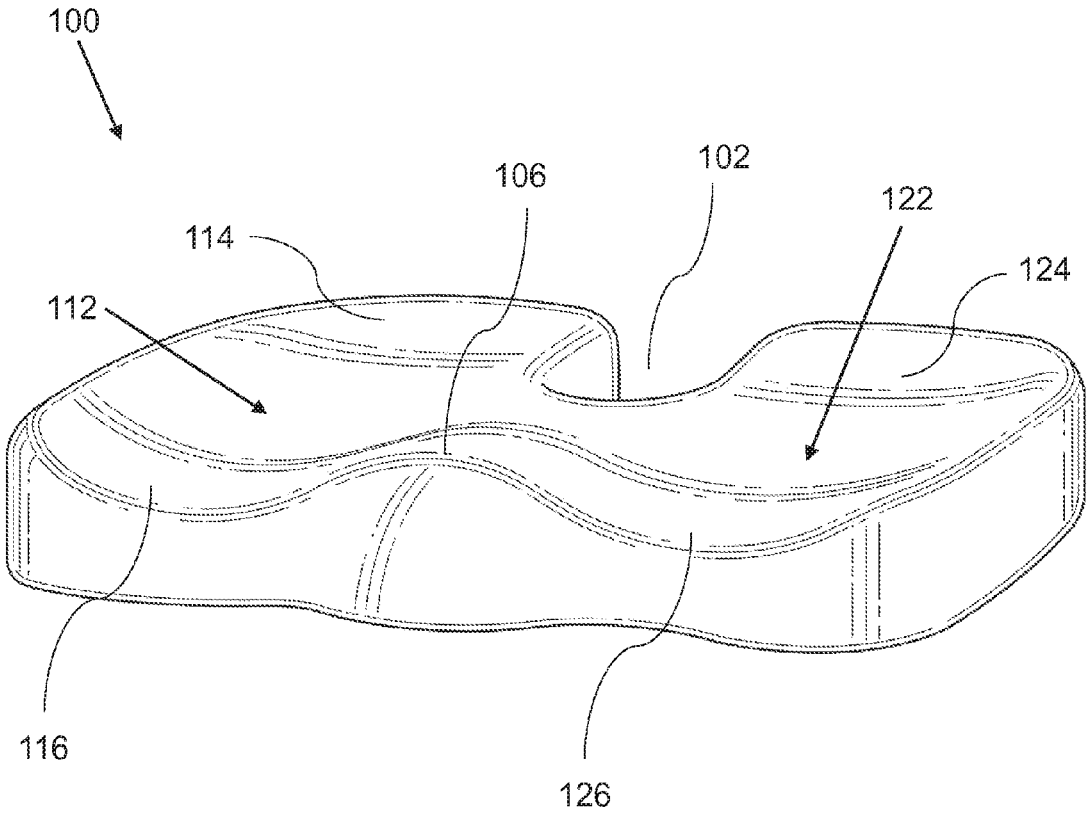
FIG. 1 is a top perspective view of a reversible orthopedic seat cushion, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of the reversible orthopedic seat cushion with reference to FIG. 1, in such manner that like reference numerals refer to like components throughout; a convention that we shall employ for the remainder of this specification.

Figure 2:
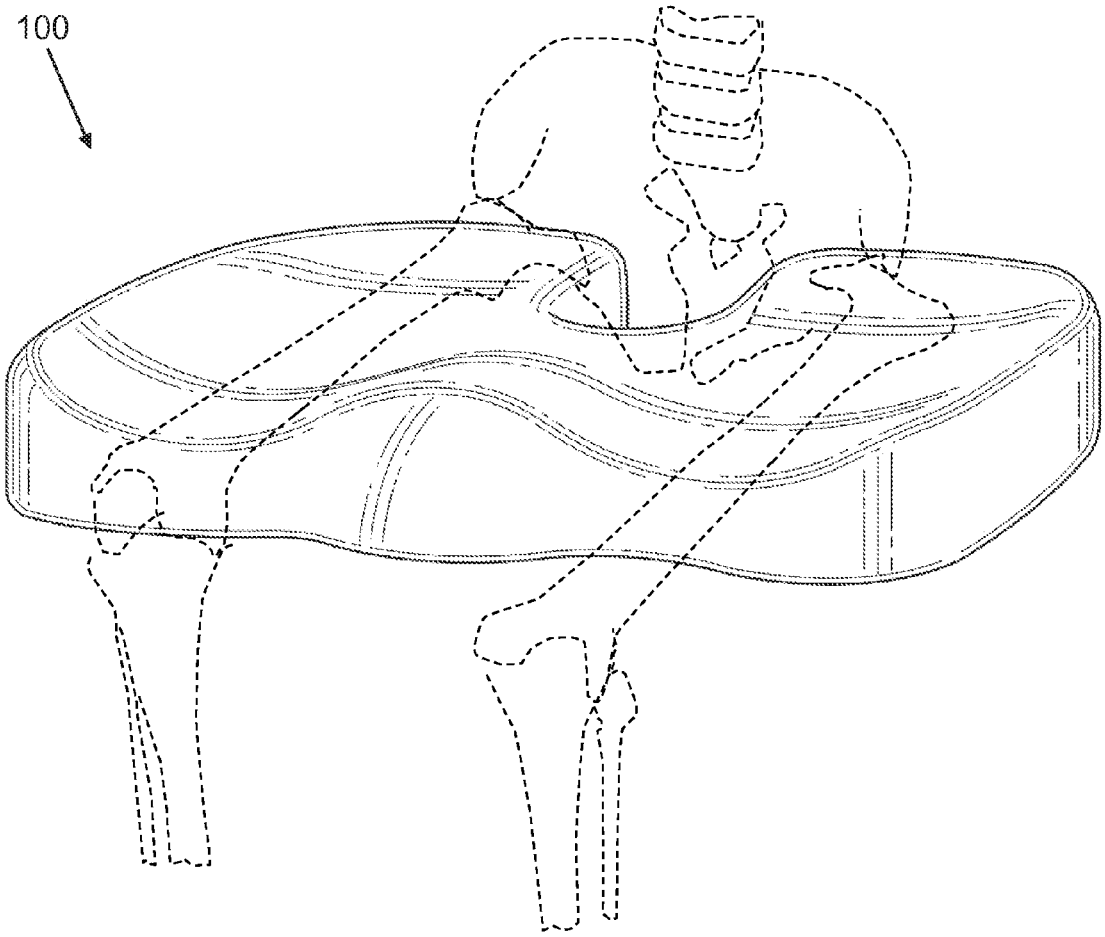
FIG. 2 is a top perspective view of a reversible orthopedic seat cushion, illustrating by superimposition the approximate seating position and support of a person's skeletal structure, according to an embodiment of the invention.

In an embodiment, a reversible orthopedic seat cushion 100 can comprise:

a. A rear-cutout 102, whereby a person when seated in a standard position can reduce pressure on the person's coccyx;

b. A right leg support channel 112, wherein the right leg support channel 112 forms a convex contoured indentation, with a right lowest point line defined from a right rear starting point 114 to a right front end point 116, wherein the right lowest point line is substantially in the middle, between the right side of the cushion and the center line of the cushion, whereby the right leg support channel 112 supports, guides, and positions the right leg of the person seated in the standard position;

c. A left leg support channel 122, wherein the left leg support channel 122 forms an convex contoured indentation, with a left lowest point line defined from a left rear starting point 124 to a left front end point 126, wherein the left lowest point line is substantially in the middle, between the left side of the cushion and the center line of the cushion, whereby the left leg support channel 122 guides and positions the left leg of the person seated in the standard position;

In an embodiment, FIG. 2 shows the same view as FIG. 1, and illustrates by superimposition the approximate seating position and support of a person's skeletal structure, shown in dotted lines, when seated in the standard position.

In an embodiment, FIG. 2 shows a top view of the reversible orthopedic seat cushion 100, further illustrating by superimposed dotted lines:

a. The right side of the cushion 302;

b. The right lowest point line 304;

c. The center line 306;

d. The left lowest point line 308; and e. The left side of the cushion 310;

In a related embodiment, the reversible orthopedic seat cushion 100 can further comprise:

a. A front concave contoured protuberance 106, wherein the protuberance 106 is centered on the centerline 306 in a front position on the pillow, positioned in a range of 10 to 30% down the length of the centerline 306 from the front, whereby the seat cushion 100 can be used in a reversed position, thereby providing a different type of support for a person sitting with the cushion in the reversed position.

Figure 6:
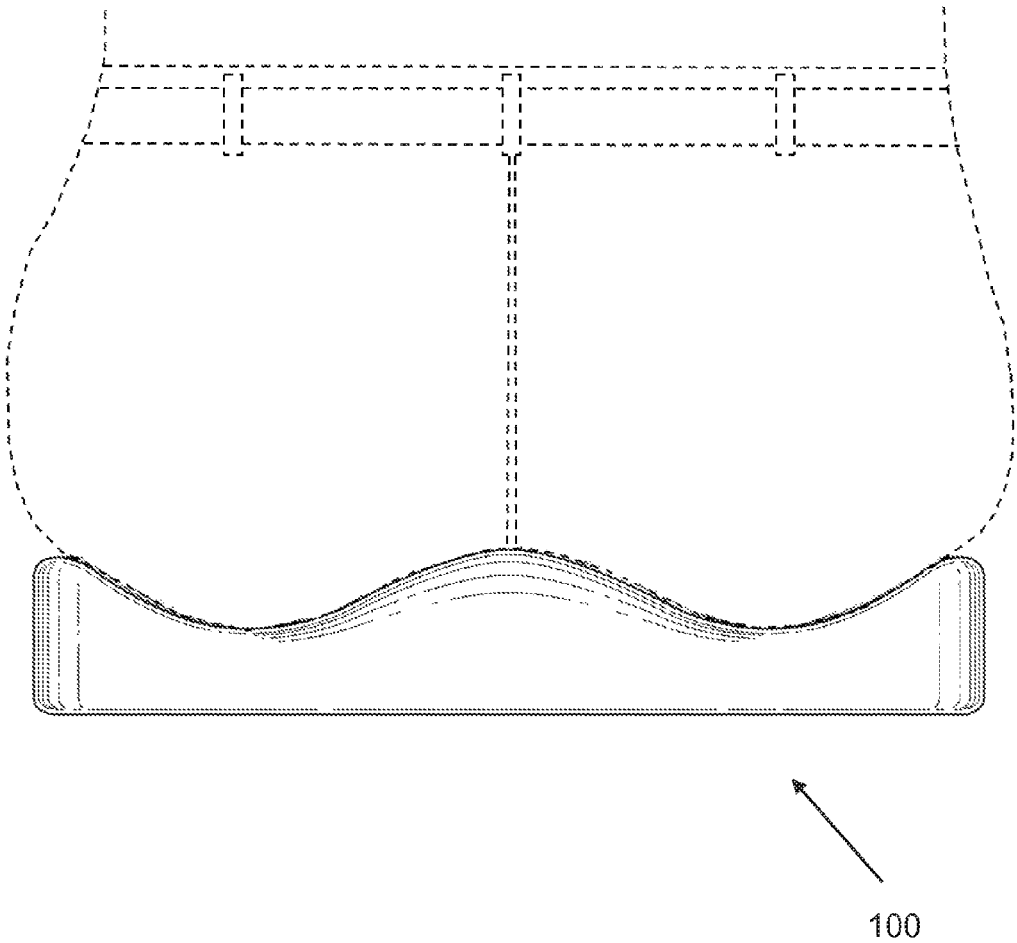
FIG. 6 is a front view of a reversible orthopedic seat cushion, illustrating use in the reversed position, showing a superimposed rear view of a sitting person, according to an embodiment of the invention.

FIG. 6 shows an example embodiment of using the reversible orthopedic seat cushion 100 in a reversed position, illustrating by superimposition in dotted lines of a rear view of a person sitting on the cushion in the reversed position.

In a related embodiment the lowest point lines 304 308, respectively:

a. from the highest right rear starting point 114 to the lowest right front end point 116; and b. from the highest left rear starting point 124 to the lowest left front end point 126;

can both have a similar slant, wherein the slant is slight, in a range from 5-20 mm per meter.

In a further related embodiment, the lowest point lines can have a zero or near zero slant in the range of 0 to 20 mm per meter.

In a further related embodiment, the lowest point lines can have a medium slant in the range of 20 to 100 mm per meter.

In a further related embodiment, the lowest point lines can have a strong slant of more than 100 mm per meter.

In a further related embodiment, the lowest point lines can have a negative slant, whereby the starting points 114 124 are lower than the ending points 116 126. Such a negative slant can for example be constrained within a range from 0 to −100 or more mm per meter.

Figure 3:
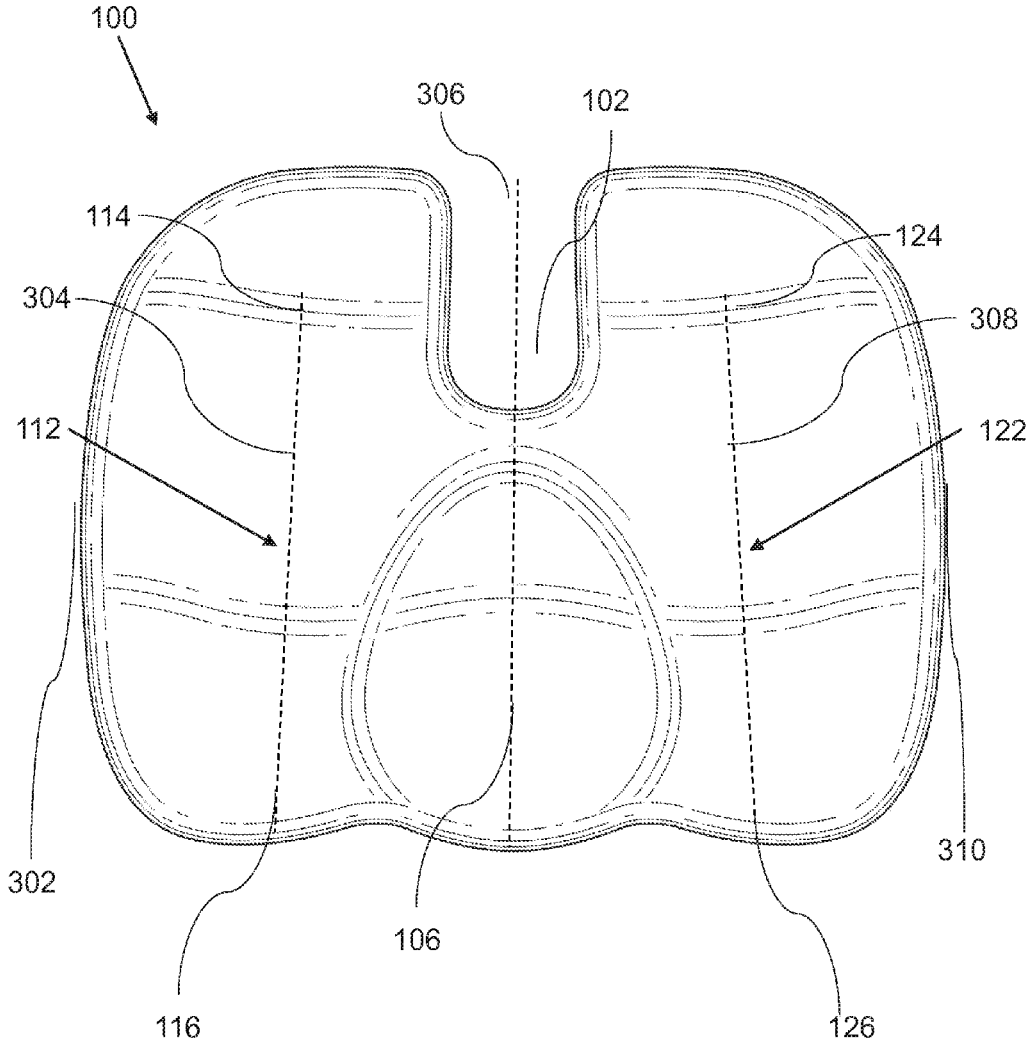
FIG. 3 is a top view of a reversible orthopedic seat cushion, according to an embodiment of the invention.

In a related embodiment, the lowest point lines can have a slight outward degree, wherein the shortest distance of the respective starting points 114 124 to the centerline 306, is slightly shorter than the shortest distance of the respective ending points 116 126 to the centerline 306. FIG. 3 shows an embodiment with a slight outward degree of the lowest point lines 112 122.

In a further related embodiment, the outward degrees can for example be equal absolute values in a range of 1 to 10 positive plane angle degrees for the right lowest point line 116, and in a range of 1 to 10 negative plane angle degrees for the left lowest point line 126, as compared to the centerline 306. Such an outward degree can support a natural leg position while seated in the standard position.

Figure 4:
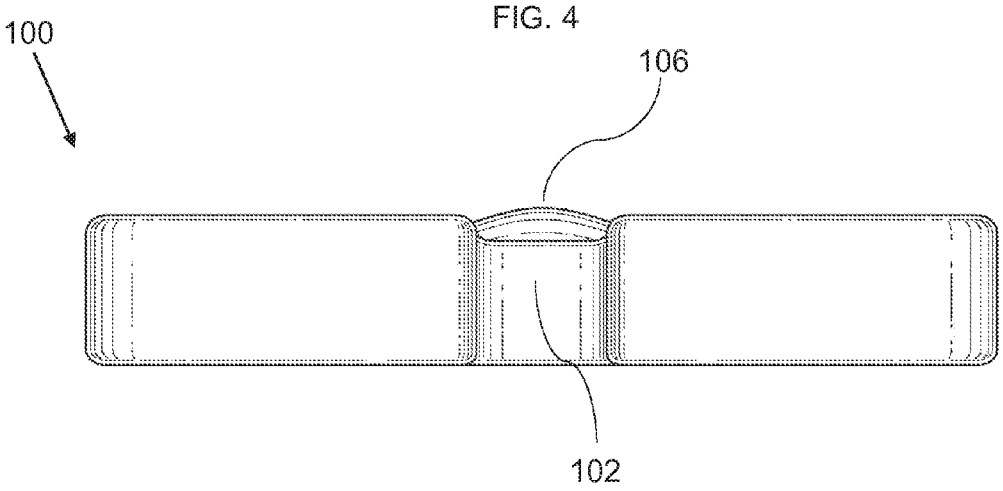
FIG. 4 is a rear view of a reversible orthopedic seat cushion, according to an embodiment of the invention.
Figure 5:
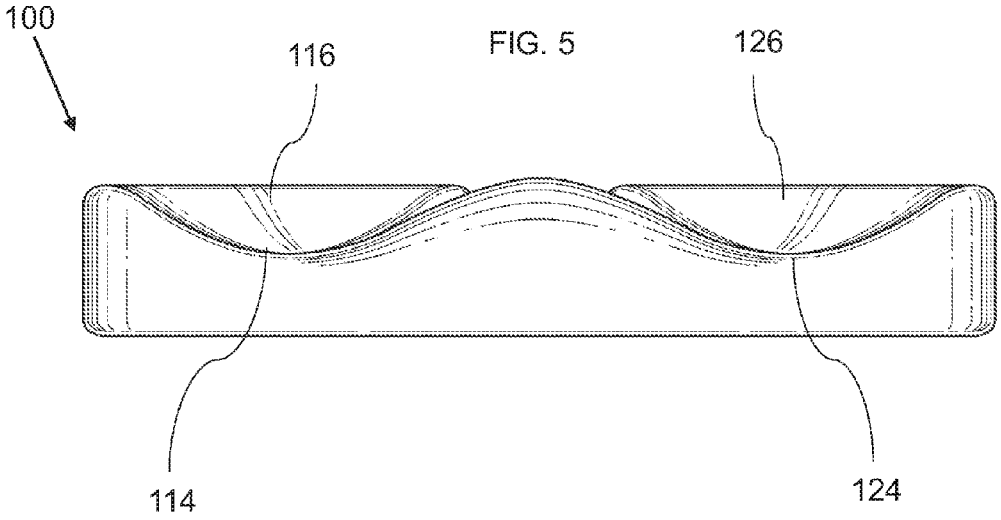
FIG. 5 is a front view of a reversible orthopedic seat cushion, according to an embodiment of the invention.

In an embodiment, FIGS. 4 and 5, show respectively a rear and front view of the reversible orthopedic seat cushion 100.

In an embodiment, the reversible orthopedic seat cushion 100 can be manufactured with an inner core made of a high-resilience upholstery foam, such as for example an open cell flexible polyurethane foam with a density in a range from 20 to 60 kg/m3, whereby the upholstery foam can provides softness to underlying hard surfaces. so that sitting can become more comfortable.

In a related embodiment, the upholstery foam can be sufficiently high-resilience and of sufficient density to not flatten out during use, and always regain its shape after use.

In a further embodiment, the inner core of the reversible orthopedic seat cushion 100, can be covered with a cushion cover, which can be made of common cushion cover materials, such as different fabrics, including velour, natural leather, suede, synthetic leather or suede, etc.

In a further related embodiment, the cushion cover can be removable, via common methods, such as for example a zip on the front underside of the cover.

In related embodiments, the reversible orthopedic seat cushion 100 can:

a. add comfort to a chair, bench, car seat, plane seat, floor, wheelchair, or other seating surface;

b. reduce, alleviate, prevent or eliminate back pain by reducing body weight pressure on the coccyx, via the rear cutout 102;

c. Promote a healthy sitting posture, proper spine alignment, superior comfort; and d. Reduce, alleviate, prevent or eliminate pressure ulcers A method of configuring a support contour or shape of a cushion to promote a healthy sitting posture, can comprise:

a. Defining leg support areas, which can be contoured channels to position, guide and support the legs;

b. Making a cut-out in the rear area of the cushion, which can ensure that there is reduced pressure on the coccyx of a person seated in the cushion;

c. Defining a front concave contoured protuberance, which can enable the cushion to be used in a reversed manner;

FIGS. 1, 2, 3, 4, 5, and 6, depict embodiments of the reversible orthopedic seat cushion 100, which includes a number of design elements that are purely aesthetic, such as for example some specific contours, the curved sides, and curved indentations on the front, seen in the top view of FIG. 3. The various embodiments of the invention described herein are multifold and can be manifested in a large plurality of different cushion designs and shapes.

The many features and advantages of the invention are apparent from the detailed specification, and thus, it is intended by the appended claims to cover all such features and advantages of the invention, which fall within the true spirit and scope of the invention.

Many such alternative configurations and shapes are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A reversible orthopedic seat cushion comprising:

a. a right leg support channel, wherein the right leg support channel forms a convex contoured indentation, with a right lowest point line from a right rear starting point to a right front end point, wherein the right lowest point line is substantially in the middle between a right side of the cushion and a center line of the cushion, whereby the right leg support channel supports, guides, and positions the right leg of a person seated in a standard position;

b. a left leg support channel, wherein the left leg support channel forms a convex contoured indentation, with a left lowest point line from a left rear starting point to a left front end point, wherein the left lowest point line is substantially in the middle between a left side of the cushion and the center line of the cushion, whereby the left leg support channel supports, guides, and positions the left leg of the person seated in the standard position;

wherein the lowest point lines have outward degrees with equal absolute value, so that the shortest distance of the respective starting points to the centerline, is shorter than the shortest distance of the respective ending points to the centerline;

wherein the right lowest point line has an outward degree in a range of 1 to 10 degrees, and the left lowest point line has an outward degree in a range of −10 to −1 degrees, as compared to the centerline in order to support a natural leg position when the person is seated in the standard position and in a reversed position.

2. The reversible orthopedic seat cushion of claim 1, further comprising a rear-cutout, whereby a person when seated in the standard position can experience reduced pressure on the person's coccyx.

3. The reversible orthopedic seat cushion of claim 1, further comprising a front concave contoured protuberance, whereby the seat cushion can be used in the reversed position, thereby providing a different type of support for a person sitting with the seat cushion in the reversed position.

4. The reversible orthopedic seat cushion of claim 1, wherein the lowest point lines have a substantially similar slant of less than 100 mm per meter.

5. The reversible orthopedic seat cushion of claim 1, wherein the lowest point lines have a near zero slant.

6. The reversible orthopedic seat cushion of claim 1, wherein the lowest point lines have a substantially similar slant of greater than −50 mm per meter.

7. The reversible orthopedic seat cushion of claim 1, wherein an inner core is manufactured using high-resilience upholstery foam.

8. The reversible orthopedic seat cushion of claim 7, wherein the inner core is made of open cell flexible polyurethane foam with a density in a range from 20 to 60 kg/m$^3$.

9. The reversible orthopedic seat cushion of claim 1, further comprising a cushion cover.

10. The reversible orthopedic seat cushion of claim 1, wherein the cushion cover is removable.

11. A method of configuring a support contour of a cushion to promote a healthy sitting posture comprising: defining leg support areas, which can be right and left contoured channels to position, guide and support the legs of a person seated in a standard position;

wherein the right contoured channel forms a convex contoured indentation, with a right lowest point line from a right rear starting point to a right front end point, wherein the right lowest point line is substantially in the middle between a right side of the cushion and a center line of the cushion;

wherein the left contoured channel forms a convex contoured indentation, with a left lowest point line from a left rear starting point to a left front end point, wherein the left lowest point line is substantially in the middle between a left side of the cushion and the center line of the cushion;

wherein the lowest point lines have outward degrees with equal absolute value, so that the shortest distance of the respective starting points to the centerline, is shorter than the shortest distance of the respective ending points to the centerline;

wherein the right lowest point line has an outward degree in a range of 1 to 10 degrees, and the left lowest point line has an outward degree in a range of −10 to −1 degrees, as compared to the centerline in order to support a natural leg position when the person is seated in the standard position and in a reversed manner.

12. The method of configuring a support contour of a cushion of claim 11, further comprising: making a cut-out in a rear area of the cushion, which can ensure that there is reduced pressure on the coccyx of a person seated in the cushion.

13. The method of configuring a support contour of a cushion of claim 11, further comprising: defining a front concave contoured protuberance, which can enable the cushion to be used in the reversed manner.

14. The method of configuring a support contour of a cushion of claim 11, wherein the leg support areas are further configured with a substantially similar slant of less than 100 mm per meter.

15. The method of configuring a support contour of a cushion of claim 11, wherein the leg support areas are further configured with a substantially similar slant of near zero.

16. The method of configuring a support contour of a cushion of claim 11, wherein an inner core is further configured using high-resilience upholstery foam.

17. The method of configuring a support contour of a cushion of claim 16, wherein the high-resilience upholstery foam is further configured with a density in a range from 20 to 60 kg/m$^3$.

18. The method of configuring a support contour of a cushion of claim 16, wherein the cushion is further configured with a cushion cover.

19. The method of configuring a support contour of a cushion of claim 16, wherein the cushion cover is removable.

* * * * *